US005983876A

United States Patent [19]

Irons et al.

[11] Patent Number: 5,983,876

[45] Date of Patent: Nov. 16, 1999

[54] SYSTEM AND METHOD FOR DETECTING AND CORRECTING CYLINDER BANK IMBALANCE

[75] Inventors: John M. Irons, Greenwood; Gregg Greathouse; Scott G. Decker, both of Columbus, all of Ind.

[73] Assignee: Cummins Engine Company, Inc., Columbus, Ind.

[21] Appl. No.: 09/033,377

[22] Filed: Mar. 2, 1998

[51] Int. Cl.[6] ..... F02D 41/14; F02D 41/16

[52] U.S. Cl. ..... 123/676; 123/478

[58] Field of Search ..... 123/406.23, 406.24, 123/406.25, 435, 436, 478, 480, 676, 691, 692; 701/103, 104, 110, 111

[56] References Cited

U.S. PATENT DOCUMENTS

| | | | |
|---|---|---|---|
| 4,197,767 | 4/1980 | Leung | 123/436 X |
| 4,875,451 | 10/1989 | Evasick et al. | 123/435 |
| 4,957,083 | 9/1990 | Nakaniwa et al. | 123/436 |
| 4,971,010 | 11/1990 | Iwata | 123/435 |
| 4,986,232 | 1/1991 | Richter et al. | 123/481 |
| 5,016,591 | 5/1991 | Nanyoshi et al. | 123/406.45 |
| 5,069,185 | 12/1991 | Evasick et al. | 123/435 |
| 5,131,371 | 7/1992 | Wahl et al. | 123/436 |
| 5,170,754 | 12/1992 | Urabe | 123/184.31 |
| 5,193,513 | 3/1993 | Marko et al. | 123/481 |
| 5,278,762 | 1/1994 | Kawamura | 123/406.47 |
| 5,291,410 | 3/1994 | Metz | 364/528.39 |
| 5,329,907 | 7/1994 | Nonaka | 123/478 |
| 5,570,574 | 11/1996 | Yamashita et al. | 60/276 |
| 5,582,151 | 12/1996 | Wertheimer | 123/435 |

FOREIGN PATENT DOCUMENTS

| | | | |
|---|---|---|---|
| 61-118539 | 6/1986 | Japan | 123/676 |

*Primary Examiner*—Tony M. Argenbright
*Attorney, Agent, or Firm*—Baker & Daniels

[57] ABSTRACT

A system and method for detecting and correcting power imbalance between cylinder banks of an internal combustion engine utilizes, in one embodiment, temperature sensors at the exhaust manifolds for each cylinder bank. A differential temperature value Δ is generated and used to determine which cylinder requires modification of its operating conditions to equalize the power output between the opposing banks. In one embodiment, the sign of the value Δ is used to determine which cylinder bank has the highest exhaust temperature, and the value Δ is provided as a multiplier to engine operating algorithms implemented by the engine control computer to derate the subject cylinder bank. In another embodiment, the value Δ is used to uprate the bank having the lower exhaust temperature, indicative of a lower power output.

20 Claims, 2 Drawing Sheets

SYSTEM AND METHOD FOR DETECTING AND CORRECTING CYLINDER BANK IMBALANCE

FIELD OF THE INVENTION

The present invention relates to the detection and correction of power imbalance conditions between multi-cylinder banks of an internal combustion engine. Specifically, this invention provides a system and method for detecting the existence of such a power imbalance and for directing an engine controller to modify the operating conditions of one of the cylinder banks to correct the imbalance. The present invention can also be utilized to detect and correct power imbalances that exist between engines of a dual engine power generation system.

BACKGROUND OF THE INVENTION

Most industrial and automotive internal combustion engines include a pair of cylinder banks, each including a plurality of cylinders. For example, a V-8 engine includes two banks of four cylinders each. With the advent of electronic controls, the operating conditions of each of the cylinders and of each bank of cylinders is controlled by an on-board engine control computer or an electronic controller. The typical electronic controller provides signals to electrically actuated fuel control systems, firing timing systems and air intake systems. In diesel engines, the electronic controller performs the critical task of controlling the timing of operation of the fuel injectors to ensure optimum combustion performance. The electronic controller also acts as a speed governor, accepting input from the accelerator pedal and sensing engine load conditions to establish an engine speed.

One problem encountered by internal combustion engines is excessive vibration and imbalanced loads applied to the engine crankshaft and output shaft. Of course, excessive vibration, particularly at engine idle, is felt, and heard, by the vehicle operator. However, the most significant risk created by engine vibration is borne by the engine itself, particularly the crankshaft and bearings. Engine vibration is known to significantly decrease the fatigue life of engine components. Moreover, engine vibration can decrease the overall engine performance, especially under critical duty cycles.

One source of engine vibration is imbalanced power output from each bank of cylinders. Ideally, opposed banks of cylinders will generate identical power output levels for identical operating conditions (i.e.—fuel quantity, injection timing, air intake). Of course, mechanical losses in each bank will be different, and the operating conditions will usually differ between banks. Unless these different mechanical losses and operating conditions are accounted for, the opposing cylinder banks will necessarily generate different power output levels.

Similar problems exist in power generation systems, for example, that utilize a plurality of engines to drive a generator. In these systems, the power output from each engine is combined by a transmission mechanism to a common output shaft. In this arrangement, power imbalance between engines can still generate vibration and fatigue problems in the transmission mechanism and common output shaft. Thus, balancing the power generated by each engine can be as important as balancing power output between opposing cylinder banks of the same engine.

While some attempt has been made to address drive shaft speed variations from cylinder to cylinder, no approach has been developed that will address the power imbalance conditions discussed above. A need therefore exists for a system and method that can readily detect power imbalance between opposing cylinder banks of an engine, as well as for power imbalances between multiple engines combined to a single output.

SUMMARY OF THE INVENTION

To address the problems of engine vibration, the present invention provides a system and method for detecting power imbalance between cylinder banks. The invention also provides means for correcting the power imbalance through the engine control computer or electronic controller. In one embodiment, cylinder bank power is determined as a function of the temperature of the exhaust from each bank. In this embodiment, a temperature sensor is disposed in the exhaust manifold of each bank to generate a signal indicative of the exhaust temperature of the bank. The temperature signals are compared to generate a delta value ($\Delta$) indicative of the magnitude of the difference between the cylinder bank exhaust temperatures.

In one feature of the invention, this delta value($\Delta$) is compared to a predetermined threshold value. The threshold value can be indicative of a temperature differential tolerance, taking into account permissible variations in sensed temperature due to the temperature sensor and/or associated electronics. The threshold value can also establish a temperature differential that can be tolerated without risk to the overall engine performance or fatigue life, thus defining an acceptable power differential.

If the delta value exceeds this threshold value, a warning signal can be provided to the vehicle operator or engine technician who can then perform a comprehensive diagnostic test of the engine to determine the probable source of the power imbalance. Alternatively, and preferably, the present invention uses the delta value to modify the operating conditions of one of the cylinder banks, in the event that the delta value exceeds the threshold value.

In a feature of the invention, the sign of the delta value is determined in order to ascertain which cylinder bank has the highest exhaust temperature, and consequently the greater power output between the opposing banks. The inventive system contemplates making this determination in either of two ways. In one embodiment, the temperature signals from the temperature sensor associated with each cylinder bank are passed through an A/D converter to generate a digital signal indicative of the magnitude of each sensor signal. These digital signals are then supplied to the electronic controller which compares these magnitude values to determine the greater of the two signals, identifies the bank having the greater magnitude signal, and then subtracts the lesser magnitude from the greater magnitude to obtain the delta value ($\Delta$).

Alternatively, the delta value can be obtained in a largely analog fashion. This can be accomplished by connecting the temperature sensors for the opposing cylinder banks in series and with reverse polarity. In this manner, only one signal is generated, which signal is representative of the voltage difference between the two temperature sensors. This differential voltage signal is then conditioned to provide a digital signal indicative of the absolute magnitude of this differential voltage, i.e.—the delta value, and a second digital value indicative of the sign of the differential voltage, but more particularly representative of the cylinder bank having the highest exhaust temperature.

If the delta value exceeds the threshold value, the electronic controller is directed to modify the operating conditions of one of the cylinder banks. In the preferred embodiment, the bank providing the greatest power output, as indicated by the higher exhaust temperature, is derated. The manner in which the cylinder bank is derated can depend upon the engine control protocol implemented by the engine control computer algorithms. Typically, the engine is derated by modifying either the fuel quantity to the cylinder bank or the injection timing. In accordance with a further aspect of the invention, the engine is derated by applying the delta value (Δ) as a multiplier to variables in the engine control algorithm. For example, this delta value can be converted to an appropriate multiplier that is applied to a fuel supply coefficient that is used to determine the quantity of fuel provided to the cylinders of the derated bank.

Alternatively, the delta value can be conditioned through a filter to provide an incremental change in the cylinder bank operating conditions. In this latter approach, the power balancing method is iterative. In other words, the engine cylinder bank can be derated a predetermined amount when a power imbalance condition is sensed. The bank exhaust temperatures can be re-evaluated to assess the magnitude of the power imbalance, if any, remaining after the each iteration. If the residual power imbalance still exceeds the threshold value, the cylinder bank is derated an additional predetermined amount. This process can continue with incremental derating of the cylinder until the power imbalance is resolved.

In some instances, derating a cylinder bank is not preferable. For example, it may be necessary to maintain a certain engine speed or power level. In this instance, the invention contemplates modifications to the above described protocol to uprate the cylinder bank generating the least power. The same delta value can be utilized to provide a multiplier to uprate one of the opposed banks. In either case, derating one bank or uprating the other bank, the revised cylinder bank operating condition can be compared to a preferred range of operating conditions to ensure that the modified bank performance does not exceed or fall below certain performance criteria.

The present invention also contemplates using a different measure of cylinder bank power output. In a further embodiment, instead of monitoring exhaust temperature, the inventive system and method measures the boost pressure at each cylinder bank. Pressure sensors can be placed in the boost inlet to the cylinders to provide signals indicative of the boost pressure in the opposed banks. The same delta value (Δ)can be derived from the difference in pressures. Since this delta value will be of a different magnitude, different conditioning of the value is needed for use in the engine control algorithms to modify the engine bank operating conditions.

The present inventive system and method for correcting cylinder bank power imbalance is preferably implemented at engine idle. The engine control module, or electronic controller, can be programmed to implement a power balance test after the engine is started. While a power imbalance condition exists, a warning indicator can inform the vehicle operator of the condition. When the imbalance is resolved, the warning indicator can be shut off so that the vehicle can then be operated.

In a further embodiment, it is contemplated that the power imbalance analysis can occur at a certain operating speed. For example, when the engine is used to drive a generator, the engine may be operated relatively continuously at a constant rated speed. The inventive system and method can be activated at the rated speed to determine if a power imbalance condition exists, and to resolve the condition if necessary. The present invention also has application to modify engine operating conditions between two engines, where both engines provide power to a common input.

It is one object of the present invention to provide a system and method for detecting and resolving a power imbalance between opposing multi-cylinder banks of an internal combustion engine. One particular object is to detect the power imbalance using engine conditions that are most indicative of the power output from each cylinder bank.

Another object is to provide a system and method that can correct the power imbalance by modifying the operating conditions of one of the cylinder banks. Other objects and special benefits provided by the present invention can be discerned from the following written description and accompanying figures.

DESCRIPTION OF THE PREFERRED EMBODIMENT

Figure 1:
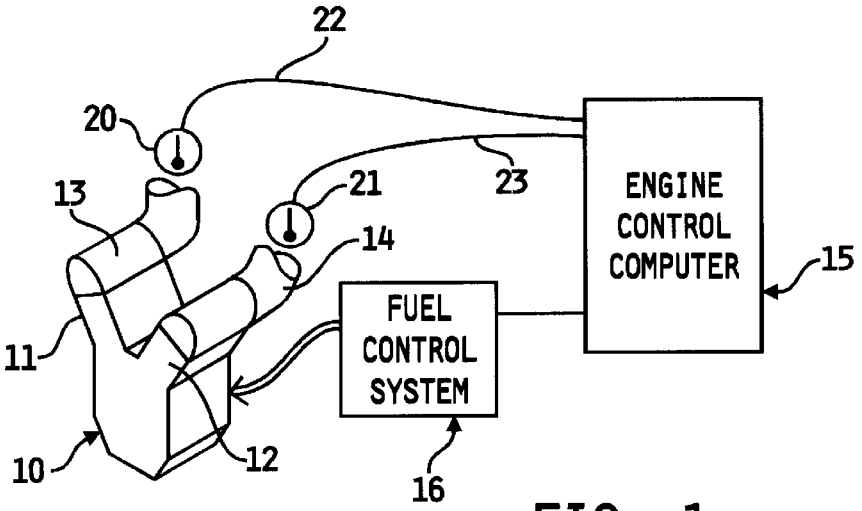
FIG. 1 is a schematic representation of an internal combustion engine incorporating the power balance detection system in accordance with one embodiment of the present invention.

For the purposes of promoting an understanding of the principles of the present invention, reference will now be made to the embodiments illustrated in the drawings and described herein. It is understood that no limitation of the scope of the invention is intended by the specific figures and description. Alterations and modifications of the illustrated system and method as would occur to persons of ordinary skill in the art are contemplated.

The present invention is provided for use with an internal combustion engine. In the preferred embodiment, the engine is a diesel engine, although the principles of the inventive system and method can be readily applied to spark ignition engines. In accordance with one embodiment of the invention, a conventional multi-cylinder V-configuration engine 10 has a left cylinder bank 11 and a right cylinder bank 12, each having the same number of individual cylinders, as shown in FIG. 1. Each cylinder bank exhausts the combustion gases through corresponding exhaust manifolds 13, 14, respectively. The operation of the engine 10 is governed by an engine control computer, or electronic controller, 15. The electronic controller 15 provides control signals to a fuel control system 16 that can control fuel quantity and injection timing for the cylinders in each bank, as well as for the aggregate of cylinders in each bank.

In accordance with the system of the present invention, a pair of temperature sensors 20, 21 are disposed at the output of the exhaust manifolds 13, 14, of left and right cylinder banks 11, 12, respectively. Signals from each of the temperature sensors are fed through wires 22, 23, respectively, to inputs of the engine control computer 15. The temperature sensors 20, 21 can be conventional thermocouples that provide a voltage output in relation to the sensed temperature. Preferably, the sensors 20, 21 have relatively fast response times so that the output temperature value does not appreciably lag the actual temperature of the exhaust gases discharged from the manifolds 13, 14. The thermocouples are most preferably averaging sensors that provide a snapshot of the widely varying gas temperature in the manifolds. Since the thermocouples 20, 21 are intended only to provide data concerning the relative temperature between cylinder banks, it is not as critical that the sensed temperature correspond exactly to the actual exhaust temperature at each manifold.

The engine control computer 15 can be of conventional design, using a microprocessor to implement instructions of various algorithms controlling the operating conditions of the engine 10. The present invention contemplates an additional algorithm to be implemented by the control computer 15, preferably during engine idle after start-up. The steps of the inventive method can be implemented a predetermined time period after the engine has been started to ensure generally steady state conditions in the exhaust manifolds 13, 14 at idle.

Figure 2:
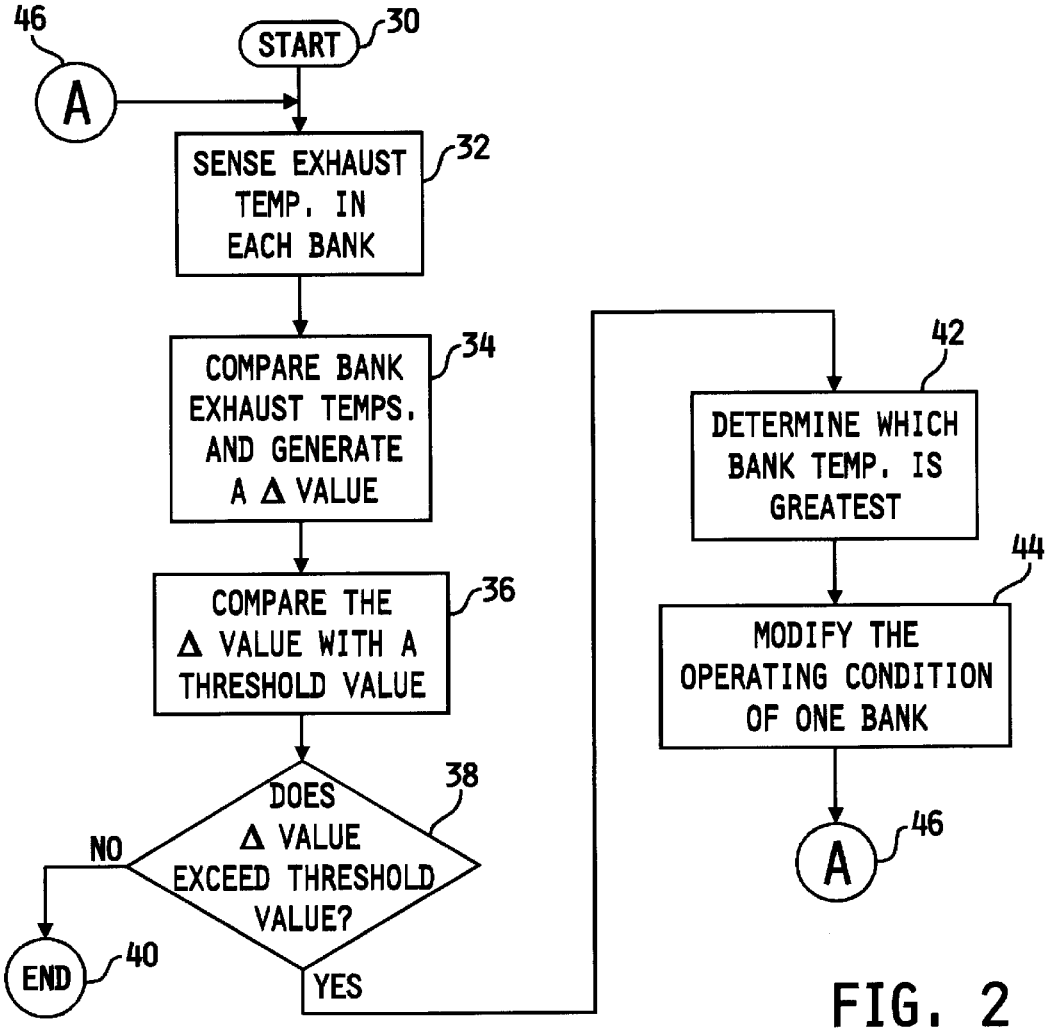
FIG. 2 is a flowchart of the method for detecting and correcting a power imbalance between opposing cylinder banks according to one embodiment of the present invention.

The steps of one embodiment of the method according to the present invention are illustrated in the flow chart of FIG. 2. The first step 30 commences the power imbalance detection and correction algorithm at a time determined by the engine control computer 15. Alternatively, this algorithm can be initiated by the vehicle technician or operator through the control computer. In the next step 32, signals from the temperature sensors 20, 21 are received by the control computer. These exhaust temperature signals are compared to each other in step 34 to derive a delta value Δ that is indicated of the relative temperature difference between the opposing cylinder banks. The value Δ is indicative of the power differential or imbalance between the opposing cylinders.

The derived value Δ is then compared to a threshold value in step 36 to determine if a true power imbalance exists between the opposed cylinder banks 11, 12. This threshold value can be predetermined to account for various errors and tolerances that arise in the measurement of the temperature of hot gases flowing through the manifolds. In addition, the threshold value can be calibrated to permit a certain amount of power imbalance to avoid unnecessary changes to the engine operating conditions. For example, a two percent difference in power output between cylinders may be tolerable from the standpoint of engine vibration and fatigue. This permissible differential can be manifested in a threshold temperature difference value at the engine idle condition.

The results of the comparison between the exhaust temperature difference value Δ and the predetermined threshold value are administered in step 38. If the value Δ does not exceed the threshold value then no actionable power imbalance exists between the cylinder banks, so the algorithm proceeds to end step 40. On the other hand, if the comparison test is satisfied, i.e.—the threshold value is exceeded by the value Δ—then the algorithm proceeds to step 42. In this step, a determination is made as to which cylinder bank has the highest exhaust temperature. Since the operating conditions of one of the cylinder banks must be modified to balance the bank power output, it is necessary to determine which bank has the highest temperature, and consequently the higer power output. This step 42 can be accomplished in different ways, as described more fully herein. Once the highest temperature, and as a consequence the lowest temperature, bank has been identified, the operating conditions of one of the banks can be modified by the engine control computer 15 in step 44. Details of this step 44 will also be described herein.

In one embodiment of the invention, the power imbalance correction algorithm can be ended after the modifying step 44. In this embodiment, the power imbalance is entirely corrected by the modifications made to the subject cylinder bank and no further evaluation or monitoring of the bank exhaust temperature is required.

In an alternative embodiment, the algorithm can be iterative, with only incremental modifications being made to the engine bank operating conditions. In this embodiment, the algorithm returns at step 46 to the start of the routine, namely to step 32 in which the bank exhaust temperatures are sensed. In this embodiment, the operating conditions of the subject cylinder bank are changed by a predetermined amount. For example, the operating conditions of the subject bank can be modified by adjusting the fuel flow to the cylinders of the bank by a fixed amount. Once the fuel flow to the affected bank has been adjusted, the exhaust temperatures can be sensed and compared to determine if a power imbalance still exists between the banks. The detection and correction steps 34–44 are repeated as described above. Since a change in operating conditions of the subject cylinder will not lead to an instantaneous change in exhaust temperature, or power output, some time delay can be built into the iteration step 46 to allow the engine to achieve its new steady state operating condition.

Figure 3:
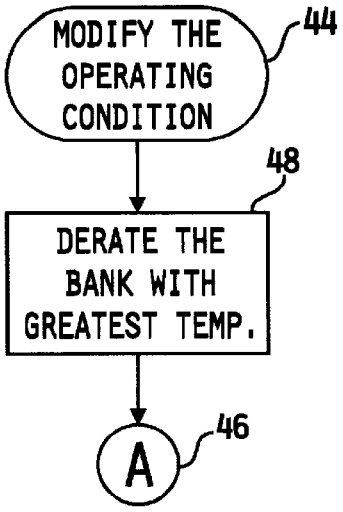
FIG. 3 is a detailed flowchart of one step of the method illustrated in the flowchart of FIG. 2 according to one specific embodiment of the invention.

The step of modifying the operating conditions of a subject bank can be accomplished in one manner depicted in the flowchart of FIG. 3. In this flowchart, step 44 includes step 48 in which the bank with the highest exhaust temperature is derated. In other words, the bank producing the higher power output is derated so that its power output is decreased to meet the power output of the opposing cylinder. The cylinder bank can be derated in a known manner, such as by decreasing fuel to the bank. Of course, the amount that the subject bank is derated is subject to the minimum operating parameters of the engine. If the low power bank and the now derated bank fall below minimum operating parameters for the engine, the vehicle technician or operator can be alerted, or the engine shut down to prevent possible damage.

Figure 4:
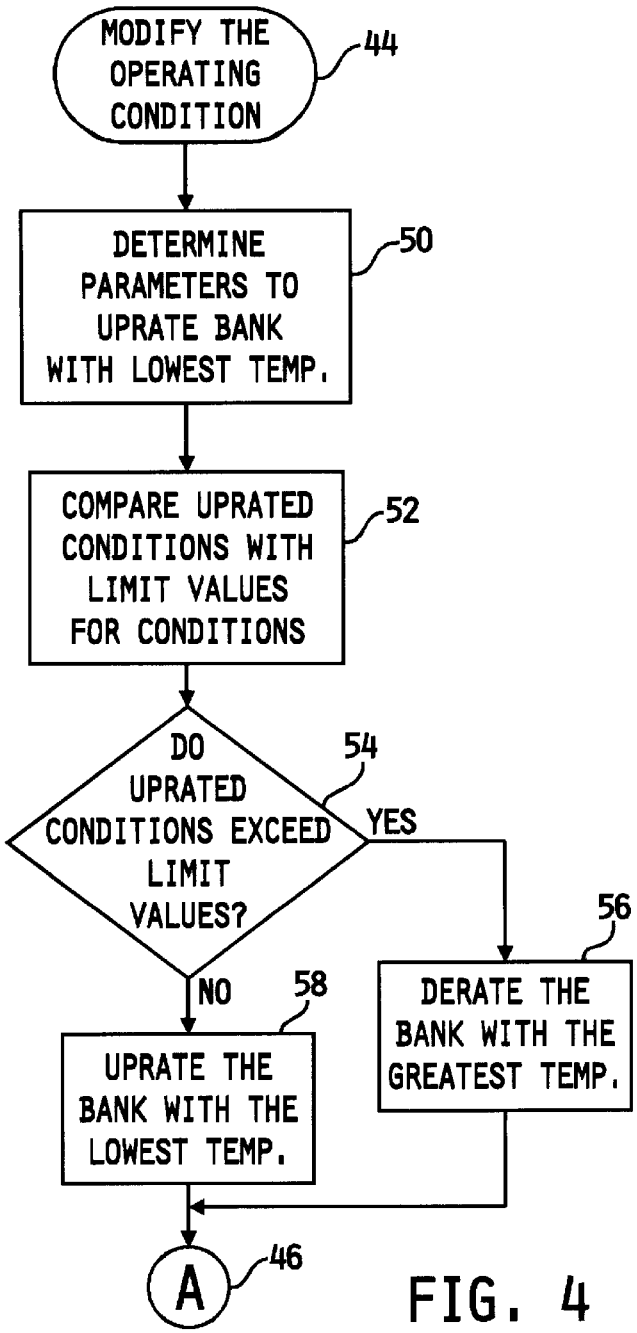
FIG. 4 is a detailed flowchart of one step of the method illustrated in the flowchart of FIG. 2 according to another specific embodiment of the invention.

As an alternative, the modifying step 44 can be accomplished according to the steps shown in FIG. 4. In this approach, step 44 includes steps 50–58 and is based upon uprating the low power cylinder bank, or increasing its power output to match the higher power output bank. The value Δ can be used as before to determine the amount that the lower temperature bank is uprated to normalize the power output between opposing banks. According to this algorithm, the temperature/power differential value Δ can be applied as a multiplier to increase an operating condition of the subject bank, such as to increase fuel flow to the cylinders of the bank. Of course, the delta value Δ can be conditioned to an appropriate multiplier for the engine condition control algorithm parameters.

In one approach, the affected cylinder can be uprated based upon limit values for the modified operating parameters. Thus, in step 50 a determination is made as to what parameters will be modified to increase power output, and the magnitude of the uprating ascertained. These uprated operating conditions are compared in step 52 to known limit values for the specific condition. For example, if it is determined that an increase in fuel to the cylinder bank is necessary to equalize power output, the increased fuel value is compared to a pre-set limit for fuel flow at idle (assuming that the steps are being conducted at engine idle speed). If the uprated conditions exceed the pre-set limit for the operating condition in step 54, then the other cylinder bank (the one with the greater power output) is derated in step 56 in a manner as described above. On the other hand, if the uprated operating conditions do not exceed the limit values, control proceeds from the test in step 54 to the next step 58 in which the engine control computer is directed to uprate the subject cylinder bank. Control of the algorithm then proceeds to the continuation step 46 as appropriate.

Referring again to FIG. 2, the step 42 of determining the higher exhaust temperature can be accomplished in a number of ways. In one embodiment, the delta value Δ can be determined digitally. In this case, the analog signals supplied by each of the temperature sensors 20, 21 on wires 22, 23, respectively, can be fed through an A/D converter to produce a digital signal. A comparator in the engine control computer 15 can compare the magnitude of the two now digital signals to produce the comparative value Δ and a binary value indicative of which one of the cylinder banks has the greater temperature. This binary value can be supplied to the engine control algorithms in the engine control computer 15 to determine which cylinder bank will be subject to a modification of its operating conditions.

Figure 5:
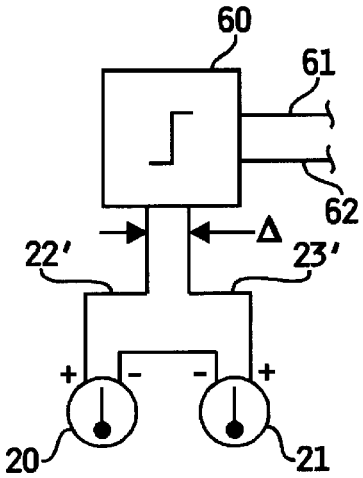
FIG. 5 is a schematic representation of the reverse polarity series connection of the temperature sensors shown in FIG. 1 according to one embodiment of the present invention.

Alternatively, a largely analog approach can be taken to determining which cylinder bank has the greater exhaust temperature, and therefor the greater power output. In this approach, the temperature sensors 20, 21 can be connected in series with reverse polarity, as illustrated in FIG. 5. In particular, the negative terminals of the temperature sensors are connected and the positive terminals are attached to wires 22' and 23', respectively. The difference in voltage between the wires 22' and 23' corresponds to the value Δ. or the difference in temperature between the opposing cylinder banks. This difference signal is applied to a threshold circuit 60 of conventional design that generates a signal on output 61 if the voltage differential is positive and on output 62 if the voltage differential is negative. In the specific embodiment, the positive differential arises if the temperature of the exhaust from the left bank 11 is greater than the exhaust temperature of the right bank 12. In the preferred embodiment, the signal on either output 61 or 62 is equal to the absolute value or magnitude of the delta value Δ so that the value can be applied directly to the engine control algorithms administered by the engine control computer.

In the prior illustrated embodiments, the operating parameter used to determine the power output of the two cylinder banks is the temperature of the exhaust gases in the respective manifolds 13, 14. Alternatively, the boost pressure from the superchargers associated with each cylinder bank can be used to provide an indication of power output. In this instance, the temperature sensors 20, 21 can be replaced by pressure sensors disposed in the air intake manifold for each cylinder bank. Preferably, the pressure sensors are conventional pressure indicators, rather than gauges or manometers, to account for the fluctuating pressures seen at the intake manifolds. Most preferably, the pressure sensors are averaging sensors to smooth out pressure spikes that may occur. Since the pressure differential value is based on different units from the temperature differential, the pressure differential value can be normalized when used by the engine control computer algorithms to modify the engine operating parameters.

In the above embodiments, the power imbalance detection and correction occurs at engine idle. It is further contemplated that the same system and method can be applied to engine speeds above idle. In some cases, performing the detection and correction steps may be better performed at a particular rated speed for the engine. For example, where an engine is used to provide power to a generator, the engine will be continuously operated at a rated speed. Rather than perform the power imbalance procedures at idle, it may be more advantageous to correct any power imbalance that occurs at the rated speed. Thus, the system and method of the present invention can be modified to be initiated by the engine control computer once the engine reaches its rated speed, or manually commenced.

The invention further contemplates applications in which multiple engines are combined through a common transmission. In systems of this type, each engine can be regarded as an individual bank of cylinders and controlled accordingly by the power imbalance detection and correction system described above. In this case, the temperature sensors can be placed at the combined exhaust of each engine and the temperature differential between engines used as a measure of the power imbalance. A separate common control computer can be provided that receives the temperature signals from the individual engines. The common control computer analyzes the temperature differential in the manner described above to provide control signals to the engine control computers of the individual engines.

While preferred embodiments of the invention have been illustrated and described in detail in the figures and accompanying specification, this description is not intended to be restrictive in character. Instead, it is understood that the present invention contemplates changes and modifications to the illustrated embodiments that may arise on consideration by a person of ordinary skill in the art to which this invention pertains.

What is claimed is:

1. For an internal combustion engine system having a plurality of banks of a plurality of cylinders and an engine control computer for controlling the operating conditions of each cylinder, a method for balancing the power output between each of said number of banks of cylinders, comprising:

measuring the value of a sensed condition of at least two of the plurality of cylinder banks:

comparing the value of the sensed condition between pairs of cylinder banks and generating a delta value indicative of the difference between such values;

comparing the delta value with a predetermined threshold value indicative of a cylinder bank power imbalance condition; and if the delta value exceeds the threshold value, generating an imbalance signal indicating that the power output between the pair of cylinders is imbalanced.

2. The method for balancing power output according to claim 1, further comprising the step of determining the sign of the imbalance signal as an indication of which of the pair of cylinder banks is generating the greatest power output between the cylinder banks.

3. The method for balancing power output according to claim 1, further comprising the step of providing the imbalance signal to the engine control computer to modify the operating conditions of one of the cylinder banks to alter the power output from the one bank.

4. The method for balancing power output according to claim 3, wherein the engine control computer derates one of the cylinder banks to decrease power output from the one bank.

5. The method for balancing power output according to claim 4, wherein the engine control computer derates the one cylinder bank as a function of the magnitude of the imbalance signal.

6. The method for balancing power output according to claim 3, wherein the engine control computer uprates the one cylinder bank to increase the power output from the one bank.

7. The method for balancing power output according to claim 6, wherein the engine control computer derates the one cylinder bank as a function of the magnitude of the imbalance signal.

8. The method for balancing power output according to claim 3, further comprising the step of evaluating the current operating conditions of each of the cylinder banks and determining whether to derate one cylinder bank or uprate the other cylinder bank based upon the current operating conditions.

9. The method for balancing power output according to claim 3, wherein the engine control computer implements algorithms to determine the quantity and timing of fuel injection to the cylinders of the one bank, and the imbalance signal is converted to a multiplier applied to such algorithms.

10. The method for balancing power output according to claim 3, wherein the step of modifying the operating conditions of one of the cylinder banks is performed iteratively by making a predetermined incremental change in operating conditions; and the method further comprises performing the measuring and comparing steps until the iterative delta value does not exceed the threshold value.

11. The method for balancing power output according to claim 1, wherein the step of measuring the value of a sensed condition includes measuring the temperature of the exhaust from at least two of the plurality of cylinder banks.

12. The method for balancing power output according to claim 1, wherein the step of measuring the value of a sensed condition includes measuring the boost pressure for at least two of the plurality of cylinder banks.

13. The method for balancing power output according to claim 1, wherein each of said steps occurs at the idle speed of the engine system.

14. The method for balancing power output according to claim 1, wherein each of said steps occurs at a rated speed of the engine system.

15. A system for balancing the power output between banks of cylinders of an internal combustion engine system, in which the operating conditions of each bank are controlled by an engine control computer, the system comprising:

a first condition sensor disposed at a first bank of cylinders of the engine system, the sensor generating a first signal indicative of a sensed condition at the first bank;

a second condition sensor disposed at a second bank of cylinders of the engine system, the sensor generating a second signal indicative of a sensed condition at the second bank;

first means for comparing the first signal and the second signal to generate a delta value indicative of the difference between the signals;

second means for comparing the delta value with a predetermined threshold value indicative of a cylinder bank power imbalance condition, said second means for comparing generating an imbalance signal if the delta value exceeds the threshold value;

means within the engine control computer for modifying the operating conditions of the cylinders in one of the cylinder banks in response to said imbalance signal.

16. The system for balancing the power output between banks according to claim 15, wherein said first means for comparing includes a series connection between said first condition sensor and said second condition sensor, said sensors being connected with opposite polarity to produce a differential voltage signal across the two sensors indicative of the difference between said first signal and said second signal.

17. The system for balancing the power output between banks according to claim 16 including an A/D converter between said first and second condition sensors and said engine control computer to convert said first and second signals to digital signals usable by said engine control computer.

18. The system for balancing the power output between banks according to claim 11, wherein:

said first condition sensor is a pressure sensor disposed at the boost pressure inlet to the first bank of cylinders of the engine system, the sensor generating said first signal indicative of the boost pressure at the cylinder bank; and said second condition sensor is a pressure sensor disposed at the boost pressure inlet to the second bank of cylinders of the engine system, the sensor generating said second signal indicative of the boost pressure at the cylinder bank.

19. The system for balancing the power output between banks according to claim 11, wherein:

said first condition sensor is a temperature sensor disposed within the exhaust of the first bank of cylinders, and the first signal is indicative of the temperature of such exhaust; and said second condition sensor is a temperature sensor disposed within the exhaust of the second bank of cylinders, and the second signal is indicative of the temperature of such exhaust.

20. The system for balancing the power output between banks according to claim 11, wherein said means for modifying is operable to modify the operating conditions as a function of the magnitude of said imbalance signal.

* * * * *